US008353169B2

(12) United States Patent
Harman et al.

(10) Patent No.: US 8,353,169 B2
(45) Date of Patent: Jan. 15, 2013

(54) SUPERSONIC COOLING SYSTEM

(75) Inventors: Jayden Harman, Novato, CA (US); Thomas Gielda, Novato, CA (US)

(73) Assignee: Pax Scientific, Inc., San Rafael, CA (US)

( * ) Notice: Subject to any disclaimer, the term of this patent is extended or adjusted under 35 U.S.C. 154(b) by 0 days.

(21) Appl. No.: 12/961,342

(22) Filed: Dec. 6, 2010

(65) Prior Publication Data

US 2011/0088878 A1 Apr. 21, 2011

Related U.S. Application Data

(63) Continuation of application No. 12/732,171, filed on Mar. 25, 2010.

(60) Provisional application No. 61/163,438, filed on Mar. 25, 2009, provisional application No. 61/228,557, filed on Jul. 25, 2009.

(51) Int. Cl.
*F25B 1/00* (2006.01)
*F25B 9/02* (2006.01)

(52) U.S. Cl. ..... 62/6; 62/116; 62/498; 62/500

(58) Field of Classification Search ..... 62/5, 61, 62/116, 500, 498, 499
See application file for complete search history.

(56) References Cited

U.S. PATENT DOCUMENTS

| | | | | |
|---|---|---|---|---|
| 1,860,447 | A | | 5/1932 | Bergdoll |
| 2,116,480 | A | | 5/1938 | Russell |
| 2,928,779 | A | | 3/1960 | Weills et al. |
| 3,228,848 | A | | 1/1966 | Fellows |
| 3,425,486 | A | | 2/1969 | Burton et al. |
| 3,510,266 | A | | 5/1970 | Midler, Jr. |
| 3,548,589 | A | | 12/1970 | Cooke-Yarborough |
| 3,552,120 | A | | 1/1971 | Beale |
| 3,621,667 | A | * | 11/1971 | Mokadam ..... 62/116 |
| 3,866,433 | A | * | 2/1975 | Krug ..... 62/229 |
| 4,031,712 | A | | 6/1977 | Costello |
| 4,044,558 | A | | 8/1977 | Benson |
| 4,057,962 | A | | 11/1977 | Belaire |
| 4,089,187 | A | | 5/1978 | Schumacher et al. |
| 4,201,263 | A | | 5/1980 | Anderson |
| 4,333,796 | A | | 6/1982 | Flynn |
| 4,442,675 | A | * | 4/1984 | Wilensky ..... 60/654 |

(Continued)

FOREIGN PATENT DOCUMENTS

EP 1 080 648 A2 7/2001

(Continued)

OTHER PUBLICATIONS

"Nozzle Applet" Published by Virginia Polytechnic Institute and State University ("Virginia Tech") and retreived on May 10, 2011 at http://www.engapplets.vt.edu/fluids/CDnozzle/cdinfo.html.*

(Continued)

*Primary Examiner* — Mohammad Ali
*Assistant Examiner* — Daniel C Comings
(74) *Attorney, Agent, or Firm* — Lewis and Roca LLP

(57) ABSTRACT

A supersonic cooling system operates by pumping liquid. Because the supersonic cooling system pumps liquid, the compression system does not require the use of a condenser. The compression system utilizes a compression wave. An evaporator of the compression system operates in the critical flow regime where the pressure in an evaporator tube will remain almost constant and then 'jump' or 'shock up' to the ambient pressure.

19 Claims, 5 Drawing Sheets

U.S. PATENT DOCUMENTS

| | | | | |
|---|---|---|---|---|
| 4,858,155 | A | 8/1989 | Okawa et al. | |
| 4,998,415 | A | 3/1991 | Larsen | |
| 5,074,759 | A | 12/1991 | Cossairt | |
| 5,083,429 | A | 1/1992 | Veres et al. | |
| 5,205,648 | A | 4/1993 | Fissenko | |
| 5,275,486 | A | 1/1994 | Fissenko | |
| 5,317,905 | A | 6/1994 | Johnson | |
| 5,338,113 | A | 8/1994 | Fissenko | |
| 5,353,602 | A * | 10/1994 | Pincus | 62/115 |
| 5,544,961 | A | 8/1996 | Fuks et al. | |
| 5,659,173 | A | 8/1997 | Putterman et al. | |
| 5,810,037 | A | 9/1998 | Sasaki et al. | |
| 5,980,698 | A | 11/1999 | Abrosimov | |
| 6,105,382 | A | 8/2000 | Reason | |
| 6,170,289 | B1 * | 1/2001 | Brown et al. | 62/511 |
| 6,190,498 | B1 * | 2/2001 | Blagborne | |
| 6,280,578 | B1 | 8/2001 | Popov | |
| 6,398,918 | B1 | 6/2002 | Popov | |
| 6,604,376 | B1 | 8/2003 | Demarco et al. | |
| 6,655,165 | B1 | 12/2003 | Eisenhour | |
| 6,719,817 | B1 | 4/2004 | Marin | |
| 6,739,141 | B1 | 5/2004 | Sienel et al. | |
| 6,835,484 | B2 | 12/2004 | Fly | |
| 6,889,754 | B2 | 5/2005 | Kroliczek et al. | |
| 7,004,240 | B1 | 2/2006 | Kroliczek et al. | |
| 7,131,294 | B2 | 11/2006 | Manole | |
| 7,178,353 | B2 | 2/2007 | Cowans et al. | |
| 7,251,889 | B2 | 8/2007 | Kroliczek et al. | |
| 7,381,241 | B2 | 6/2008 | Tessien et al. | |
| 7,387,093 | B2 | 6/2008 | Hacsi | |
| 7,387,660 | B2 | 6/2008 | Tessien et al. | |
| 7,399,545 | B2 | 7/2008 | Fly | |
| 7,415,835 | B2 | 8/2008 | Cowans et al. | |
| 7,448,790 | B2 | 11/2008 | Tessien et al. | |
| 7,549,461 | B2 | 6/2009 | Kroliczek et al. | |
| 7,654,095 | B2 | 2/2010 | Sullivan | |
| 7,656,808 | B2 | 2/2010 | Manthoulis et al. | |
| 7,708,053 | B2 | 5/2010 | Kroliczek et al. | |
| 7,721,569 | B2 | 5/2010 | Manole | |
| 7,726,135 | B2 | 6/2010 | Sullivan | |
| 7,765,820 | B2 | 8/2010 | Cowans et al. | |
| 7,796,389 | B2 | 9/2010 | Edmunds et al. | |
| 2002/0090047 | A1 | 7/2002 | Stringham | |
| 2002/0177035 | A1 | 11/2002 | Oweis et al. | |
| 2004/0172966 | A1 | 9/2004 | Ozaki et al. | |
| 2005/0048339 | A1 * | 3/2005 | Fly | 165/138 |
| 2006/0018419 | A1 | 1/2006 | Tessien | |
| 2006/0018420 | A1 | 1/2006 | Tessien | |
| 2006/0032625 | A1 | 2/2006 | Angelis et al. | |
| 2006/0191049 | A1 | 8/2006 | Elkins et al. | |
| 2007/0028646 | A1 | 2/2007 | Oshitani et al. | |
| 2007/0199333 | A1 | 8/2007 | Windisch | |
| 2007/0271939 | A1 | 11/2007 | Ichigaya | |
| 2008/0006051 | A1 | 1/2008 | Johnson | |
| 2008/0057382 | A1 | 3/2008 | Kimura | |
| 2008/0105315 | A1 | 5/2008 | Botros et al. | |
| 2008/0277098 | A1 | 11/2008 | Fly | |
| 2008/0292948 | A1 | 11/2008 | Kumar et al. | |
| 2009/0272128 | A1 | 11/2009 | Ali | |
| 2009/0293513 | A1 | 12/2009 | Sullivan | |
| 2010/0043633 | A1 | 2/2010 | Galbraith | |
| 2010/0090469 | A1 | 4/2010 | Sullivan | |
| 2010/0126212 | A1 | 5/2010 | May | |
| 2010/0154445 | A1 | 6/2010 | Sullivan | |
| 2010/0287954 | A1 | 11/2010 | Harman et al. | |
| 2011/0030390 | A1 | 2/2011 | Charamko et al. | |
| 2011/0048048 | A1 | 3/2011 | Gielda et al. | |
| 2011/0048062 | A1 | 3/2011 | Gielda et al. | |
| 2011/0048066 | A1 | 3/2011 | Gielda et al. | |
| 2011/0051549 | A1 | 3/2011 | Debus et al. | |
| 2011/0088419 | A1 | 4/2011 | Harman et al. | |
| 2011/0094249 | A1 | 4/2011 | Harman et al. | |
| 2011/0113792 | A1 | 5/2011 | Harman et al. | |
| 2011/0117511 | A1 | 5/2011 | Harman et al. | |
| 2011/0139405 | A1 | 6/2011 | Harman et al. | |
| 2012/0000631 | A1 | 1/2012 | Charamko et al. | |
| 2012/0118538 | A1 | 5/2012 | Gielda et al. | |
| 2012/0205080 | A1 | 8/2012 | Debus et al. | |
| 2012/0260673 | A1 | 10/2012 | Charamko et al. | |
| 2012/0260676 | A1 | 10/2012 | Charamko et al. | |

FOREIGN PATENT DOCUMENTS

| | | | |
|---|---|---|---|
| JP | 60-175980 | | 9/1985 |
| JP | 2002130770 | | 5/2002 |
| JP | 2003021410 | | 1/2003 |
| JP | 2003034135 | | 2/2003 |
| JP | 2005-240689 | | 9/2005 |
| JP | 2009-221883 | | 10/2009 |
| WO | 2004072567 | A2 | 8/2004 |
| WO | WO 2006/054408 | | 5/2006 |
| WO | 2006137850 | A2 | 12/2006 |
| WO | 2009070728 | A1 | 6/2009 |
| WO | 2009123674 | A2 | 10/2009 |
| WO | 2010042467 | A2 | 4/2010 |

OTHER PUBLICATIONS

U.S. Appl. No. 12/753,824, filed Apr. 2, 2010, Serguei Charamko, Vortex Tube.

U.S. Appl. No. 12/843,834, filed Jul. 26, 2010. Kristian Debus, Nucleation Ring for a Central Insert.

U.S. Appl. No. 12/876,985, filed Sep. 7, 2010, Jayden David Harman, System and Method for Heat Transfer.

U.S. Appl. No. 12/945,799, filed Nov. 12, 2010, Thomas Gielda, Pump-Less Cooling.

U.S. Appl. No. 12/880,940, filed Sep. 13, 2010, Thomas Gielda, Portable Cooling Unit.

U.S. Appl. No. 12/902,056, filed Oct. 11, 2010, Thomas Gielda, Battery Cooling.

U.S. Appl. No. 12/902,060, filed Oct. 11, 2010, Thomas Gielda, Personal Cooling System.

Energy Efficiency Manual, "Compression Cooling," D.R. Wulfinghoff, 1999, pp. 1299-1321.

M.Guglielmone et al., Heat Recovery from Vapor Compression Air Conditioning: A Brief Introduction, Turbotec Products, Inc., May 14, 2008.

Robert H. Turner, Water Consumption of Evaporative Cooling Systems, 21st Intersociety Energy Conservation Engineering Conference, San Diego, California, Aug. 25-29, 1986.

S. Klein et al., "Solar Refrigeration," American Society of Heating, Refrigerating and Conditioning Engineers, Inc., ASHRAE Journal, vol. 47 No. 9, Sep. 2005.

NASA Tech Briefs, "Vapor-Compression Solar Refrigerator Without Batteries," Sep. 2001, http://www.techbriefs.com/component/content/article/7426.

Wikipedia, "Stirling engine," http://en.wikipedia.org/wiki/Stirling_engine, visited May 3, 2010.

Combined search and examination report mailed Jan. 21, 2011 in U.K. patent application No. GB1021925.1.

Fox, et al., "Supersonic Cooling by Shock-Vortex Interaction," J. Fluid Mech. 1996, vol. 308, pp. 363-379.

Hu, et al., "Numerical and Experimental Study of a Hydrodynamic Cavitation Tube," Metallurgical and Materials Transactions B, vol. 29B, Aug. 1998.

Mishra, et al., "Development of Cavitation in Refrigerant (R-123) Flow Inside Rudimentary Microfluidic Systems," Journal of Microelectromechanical Systems, vol. 15, No. 5, Oct. 2006.

Non-final office action mailed Feb. 4, 2011 in U.S. Appl. No. 12/960,979.

Non-final office action mailed Feb. 16, 2011 in U.S. Appl. No. 12/961,015.

U.S. Appl. No. 13/048,633, filed Mar. 15, 2011, David Halt, Supersonic Cooling Nozzle With Airfoils.

U.S. Appl. No. 13/087,062, filed Apr. 14, 2011, Serguei Charamko, Cooling System Utilizing a Reciprocating Piston.

U.S. Appl. No. 13/088,593, filed Apr. 18, 2011, Serguei Charamko, Cooling System Utilizing a Conical Body.

U.S. Appl. No. 13/113,626, filed May 23, 2011, Kristian Debus et al., Supersonic Cooling Nozzle Inlet.

U.S. Appl. No. 13/115,930, filed May 25, 2011, Tom Gielda, Supersonic Cooling With Pulsed Inlet and Bypass Loop.

International Preliminary Report on Patentability mailed on Aug. 19, 2011 in Patent Cooperation Treaty application No. PCT/US2010/28761 filed Mar. 25, 2010.
International Search Report mailed Patent Cooperation Treaty application No. PCT/US2011/027845 filed Mar. 10, 2011.
Interview Summary mailed Mar. 16, 2011 in U.S. Appl. No. 12/960,979, filed Dec. 6, 2010.
Final Office Action mailed May 19, 2011 in U.S. Appl. No. 12/960,979, filed Dec. 6, 2010.
Interview Summary mailed Mar. 10, 2011 in U.S. Appl. No. 12/961,015, filed Dec. 6, 2010.
Office Action mailed Mar. 18, 2011 in U.S. Appl. No. 12/961,386, filed Dec. 6, 2010.
"Nozzle Applet" Published by Virginia Polytechnic Institue and State University (Virginia Tech) and retrieved on May 10, 2011 at http://www.engapplets.vt.edu/fluids/CDnozzle/cdinfo.html.
PCT Application No. PCT/US2012/021140, International Search Report mailed Jun. 12, 2012, 3pgs.
PCT Application No. PCT/US2012/021139, International Search Report mailed Aug. 14, 2012, 3pgs.
U.S. Appl. No. 12/732,171, Office Action mailed Jan. 23, 2012.
U.S. Appl. No. 12/876,985, Office Action mailed Feb. 29, 2012.
U.S. Appl. No. 12/880,940, Office Action mailed Sep. 19, 2012.
U.S. Appl. No. 12/902,056, Office Action mailed Sep. 14, 2012.
U.S. Appl. No. 12/902,060, Office Action mailed Sep. 26, 2012.
U.S. Appl. No. 12/960,979, Office Action mailed Mar. 9, 2012.
U.S. Appl. No. 12/961,015, Office Action mailed Jul. 3, 2012.
U.S. Appl. No. 12/961,015, Final Office Action mailed Dec. 9, 2011.
U.S. Appl. No. 12/961,366, Final Office Action mailed Aug. 31, 2012.
U.S. Appl. No. 12/961,366, Office Action mailed Feb. 24, 2012.
U.S. Appl. No. 12/961/386, Final Office Action mailed Dec. 13, 2011.

* cited by examiner $$COP = 2.4 : \frac{\text{Evaporator Cooling Power}}{\text{Compressor Power}}$$

SUPERSONIC COOLING SYSTEM

CROSS-REFERENCE TO RELATED APPLICATIONS

The present application is a continuation and claims the priority benefit of U.S. patent application Ser. No. 12/732,171 filed Mar. 25, 2010, which claims the priority benefit of U.S. provisional application No. 61/163,438 filed Mar. 25, 2009 and U.S. provisional application No. 61/228,557 filed Jul. 25, 2009. The disclosure of each of the aforementioned applications is incorporated herein by reference.

BACKGROUND OF THE INVENTION

1. Field of the Invention

The present invention generally relates to cooling systems. The present invention more specifically relates to supersonic cooling systems.

2. Description of the Related Art

A vapor compression system as known in the art generally includes a compressor, a condenser, and an evaporator. These systems also include an expansion device. In a prior art vapor compression system, a gas is compressed whereby the temperature of that gas is increased beyond that of the ambient temperature. The compressed gas is then run through a condenser and turned into a liquid. The condensed and liquefied gas is then taken through an expansion device, which drops the pressure and the corresponding temperature. The resulting refrigerant is then boiled in an evaporator. This vapor compression cycle is generally known to those of skill in the art.

FIG. 1 illustrates a vapor compression system 100 as might be found in the prior art. In the prior art vapor compression system 100 of FIG. 1, compressor 110 compresses the gas to (approximately) 238 pounds per square inch (PSI) and a temperature of 190 F. Condenser 120 then liquefies the heated and compressed gas to (approximately) 220 PSI and 117 F. The gas that was liquefied by the condenser (120) is then passed through the expansion valve 130 of FIG. 1. By passing the liquefied gas through expansion value 130, the pressure is dropped to (approximately) 20 PSI. A corresponding drop in temperature accompanies the drop in pressure, which is reflected as a temperature drop to (approximately) 34 F in FIG. 1. The refrigerant that results from dropping the pressure and temperature at the expansion value 130 is boiled at evaporator 140. Through boiling of the refrigerant by evaporator 140, a low temperature vapor results, which is illustrated in FIG. 1 as having (approximately) a temperature of 39 F and a corresponding pressure of 20 PSI.

The cycle related to the system 100 of FIG. 1 is sometimes referred to as the vapor compression cycle. Such a cycle generally results in a coefficient of performance (COP) between 2.4 and 3.5. The coefficient of performance, as reflected in FIG. 1, is the evaporator cooling power or capacity divided by compressor power. It should be noted that the temperature and PSI references that are reflected in FIG. 1 are exemplary and illustrative.

A vapor compression system 100 like that shown in FIG. 1 is generally effective. FIG. 2 illustrates the performance of a vapor compression system like that illustrated in FIG. 1. The COP illustrated in FIG. 2 corresponds to a typical home or automotive vapor compression system—like that of FIG. 1—with an ambient temperature of (approximately) 90 F. The COP shown in FIG. 2 further corresponds to a vapor compression system utilizing a fixed orifice tube system.

Such a system 100, however, operates at an efficiency rate (e.g., coefficient of performance) that is far below that of system potential. To compress gas in a conventional vapor compression system (100) like that illustrated in FIG. 1 typically takes 1.75-2.5 kilowatts for every 5 kilowatts of cooling power. This exchange rate is less than optimal and directly correlates to the rise in pressure times the volumetric flow rate. Degraded performance is similarly and ultimately related to performance (or lack thereof) by the compressor (110).

Haloalkane refrigerants such as tetrafluoroethane ($CH_2FCF_3$) are inert gases that are commonly used as high-temperature refrigerants in refrigerators and automobile air conditioners. Tetrafluoroethane have also been used to cool over-clocked computers. These inert, refrigerant gases are more commonly referred to as R-134 gases. The volume of an R-134 gas can be 600-1000 times greater than the corresponding liquid. As such, there is a need in the art for an improved cooling system that more fully recognizes system potential and overcomes technical barriers related to compressor performance.

SUMMARY OF THE CLAIMED INVENTION

In a first claimed embodiment of the present invention, a supersonic cooling system is disclosed. The supersonic cooling system includes a pump that maintains a circulatory fluid flow through a flow path and an evaporator. The evaporator operates in the critical flow regime and generates a compression wave. The compression wave shocks the maintained fluid flow thereby changing the PSI of the maintained fluid flow and exchanges heat introduced into the fluid flow.

In a specific implementation of the first claimed embodiment, the pump and evaporator are located within a housing. The housing may correspond to the shape of a pumpkin. An external surface of the housing may effectuate forced convection and a further exchange of heat introduced into the compression system.

The pump of the first claimed embodiment may maintain the circulatory fluid flow by using vortex flow rings. The pump may progressively introduce energy to the vortex flow rings such that the energy introduced corresponds to energy being lost through dissipation.

A second claimed embodiment of the present invention sets for a cooling method. Through the cooling method of the second claimed embodiment, a compression wave is established in a compressible fluid. The compressible liquid is transported from a high pressure region to a low pressure region and the corresponding velocity of the fluid is greater or equal to the speed of sound in the compressible fluid. Heat that has been introduced into the fluid flow is exchanged as a part of a phase change of the compressible fluid.

DETAILED DESCRIPTION

Figure 3:
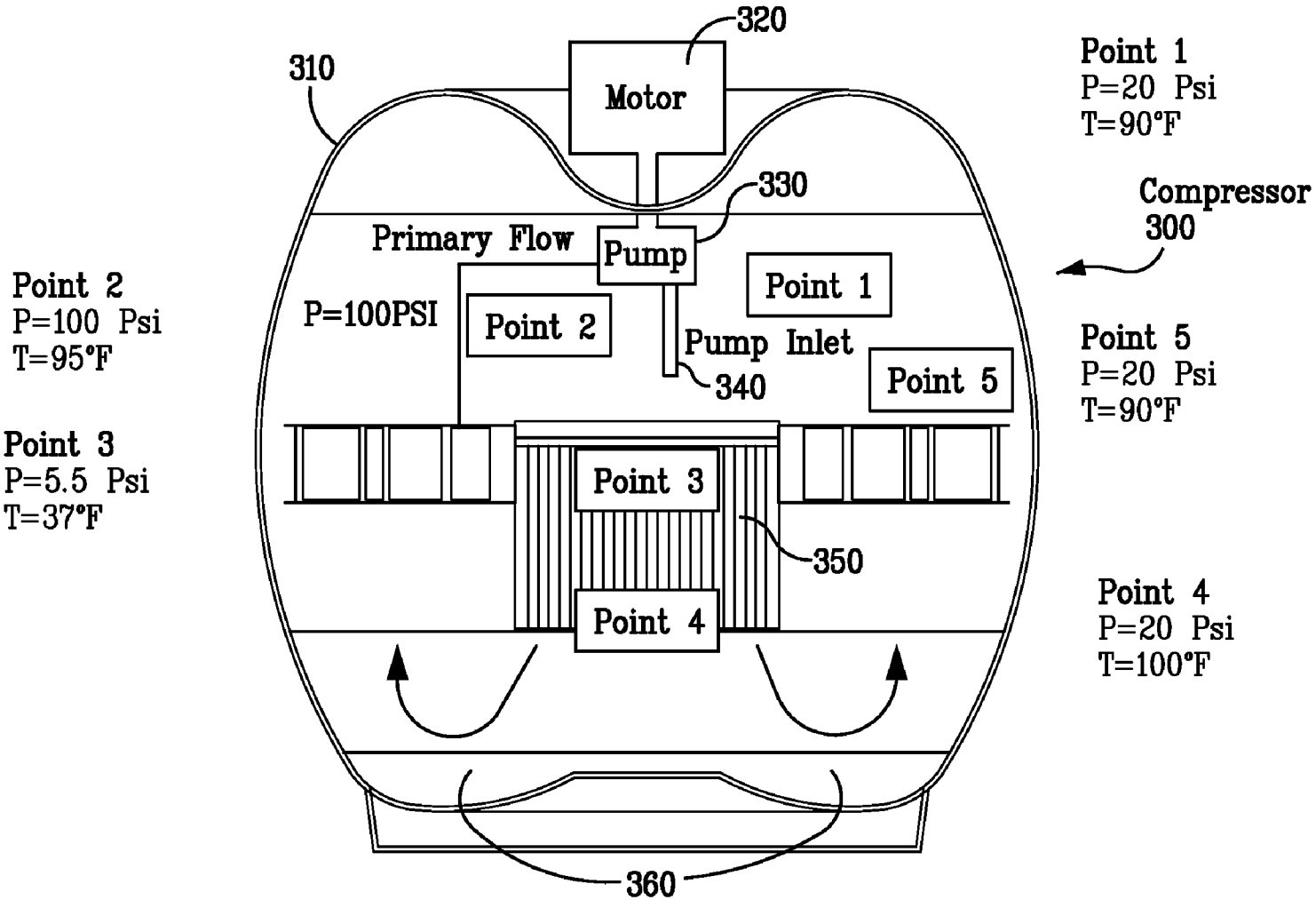
FIG. 3 illustrates an exemplary supersonic cooling system in accordance with an embodiment of the present invention.

FIG. 3 illustrates an exemplary supersonic cooling system 300 in accordance with an embodiment of the present invention. The supersonic cooling system 300 does not need to compress a gas as otherwise occurs at compressor (110) in a prior art vapor compression system 100 like that shown in FIG. 1. Supersonic cooling system 300 operates by pumping liquid. Because supersonic cooling system 300 pumps liquid, the compression system 300 does not require the use a condenser (120) as does the prior art compression system 100 of FIG. 1. Compression system 300 instead utilizes a compression wave. The evaporator of compression system 300 operates in the critical flow regime where the pressure in an evaporator tube will remain almost constant and then 'jump' or 'shock up' to the ambient pressure.

Figure 1:
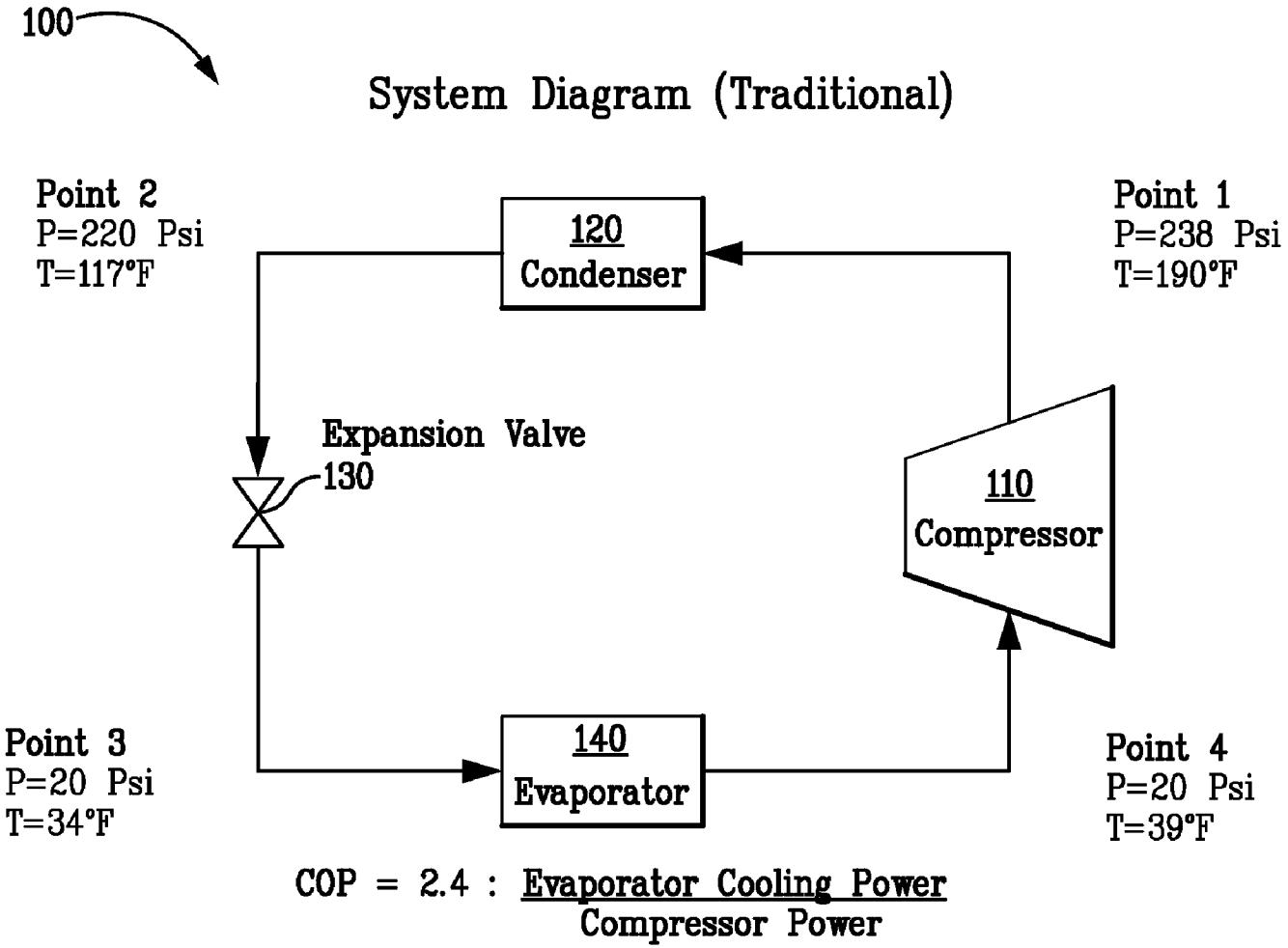
FIG. 1 (Prior Art)
FIG. 1 illustrates a vapor compression system as might be found in the prior art.
Figure 2:
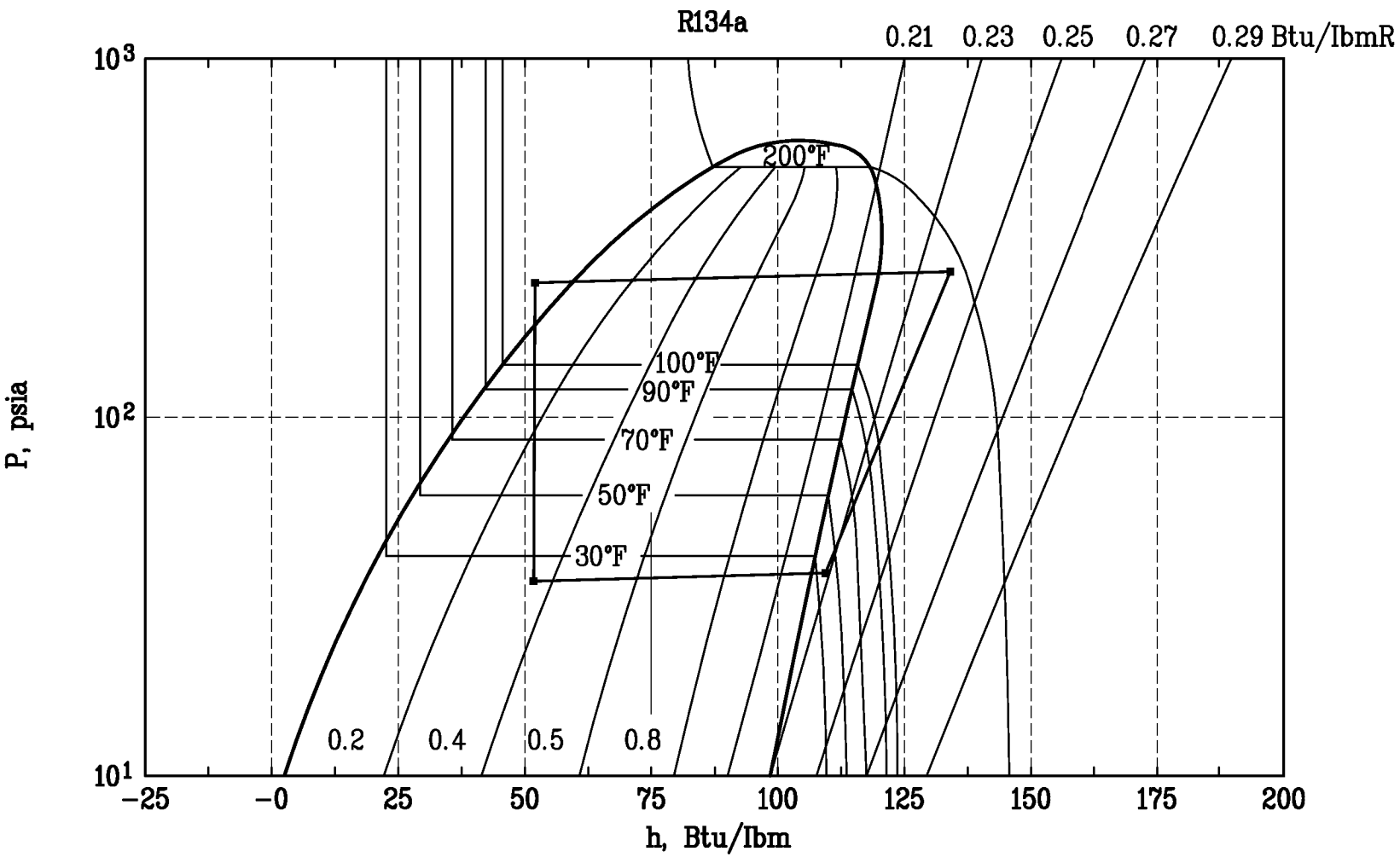
FIG. 2 (Prior Art)
FIG. 2 illustrates the performance of a vapor compression system like that illustrated in FIG. 1.

The supersonic cooling system 300 of FIG. 3 recognizes a certain degree of efficiency in that the pump (320) of the system 300 does not (nor does it need to) draw as much power as the compressor (110) in a prior art compression system 100 like that shown in FIG. 1. A compression system designed according to an embodiment of the presently disclosed invention may recognize exponential pumping efficiencies. For example, where a prior art compression system (100) may require 1.75-2.5 kilowatts for every 5 kilowatts of cooling power, an system (300) like that illustrated in FIG. 3 may pump liquid from 14.7 to 120 PSI with the pump drawing power at approximately 500 W. As a result of these efficiencies, system 300 may utilize many working fluids, including but not limited to water.

The supersonic cooling system 300 of FIG. 3 includes housing 310. Housing 310 of FIG. 3 is akin to that of a pumpkin. The particular shape or other design of housing 310 may be a matter of aesthetics with respect to where or how the system 300 is installed relative a facility or coupled equipment or machinery. Functionally, housing 310 encloses pump 330, evaporator 350, and accessory equipment or flow paths corresponding to the same (e.g., pump inlet 340 and evaporator tube 360). Housing 310 also maintains (internally) the cooling liquid to be used by the system 300.

Housing 310, in an alternative embodiment, may also encompass a secondary heat exchanger (not illustrated). A secondary heat exchanger may be excluded from being contained within the housing 310 and system 300. In such an embodiment, the surface area of the system 300—that is, the housing 310—may be utilized in a cooling process through forced convection on the external surface of the housing 310.

Pump 330 may be powered by a motor 320, which is external to the system 300 and located outside the housing 310 in FIG. 3. Motor 320 may alternatively be contained within the housing 310 of system 300. Motor 320 may drive the pump 330 of FIG. 3 through a rotor drive shaft with a corresponding bearing and seal or magnetic induction, whereby penetration of the housing 310 is not required. Other motor designs may be utilized with respect to motor 320 and corresponding pump 330 including synchronous, alternating (AC), and direct current (DC) motors. Other electric motors that may be used with system 300 include induction motors; brushed and brushless DC motors; stepper, linear, unipolar, and reluctance motors; and ball bearing, homopolar, piezoelectric, ultrasonic, and electrostatic motors.

Pump 330 establishes circulation of a liquid through the interior fluid flow paths of system 300 and that are otherwise contained within housing 310. Pump 330 may circulate fluid throughout system 300 through use of vortex flow rings. Vortex rings operate as energy reservoirs whereby added energy is stored in the vortex ring. The progressive introduction of energy to a vortex ring via pump 330 causes the corresponding ring vortex to function at a level such that energy lost through dissipation corresponds to energy being input.

Pump 330 also operates to raise the pressure of a liquid being used by system 300 from, for example, 20 PSI to 100 PSI or more. Pump inlet 340 introduces a liquid to be used in cooling and otherwise resident in system 300 (and contained within housing 310) into pump 330. Fluid temperature may, at this point in the system 300, be approximately 95 F.

The fluid introduced to pump 330 by inlet 340 traverses a primary flow path to nozzle/evaporator 350. Evaporator 350 induces a pressure drop (e.g., to approximately 5.5 PSI) and phase change that results in a low temperature. The cooling fluid further 'boils off' at evaporator 350, whereby the resident liquid may be used as a coolant. For example, the liquid coolant may be water cooled to 35-45 F (approximately 37 F as illustrated in FIG. 3). As noted above, the system 300 (specifically evaporator 350) operates in the critical flow regime thereby allowing for establishment of a compression wave. The coolant fluid exits the evaporator 350 via evaporator tube 360 where the fluid is 'shocked up' to approximately 20 PSI because the flow in the evaporator tube 360 is in the critical regime. In some embodiments of system 300, the nozzle/evaporator 350 and evaporator tube 360 may be integrated and/or collectively referred to as an evaporator.

Figure 4:
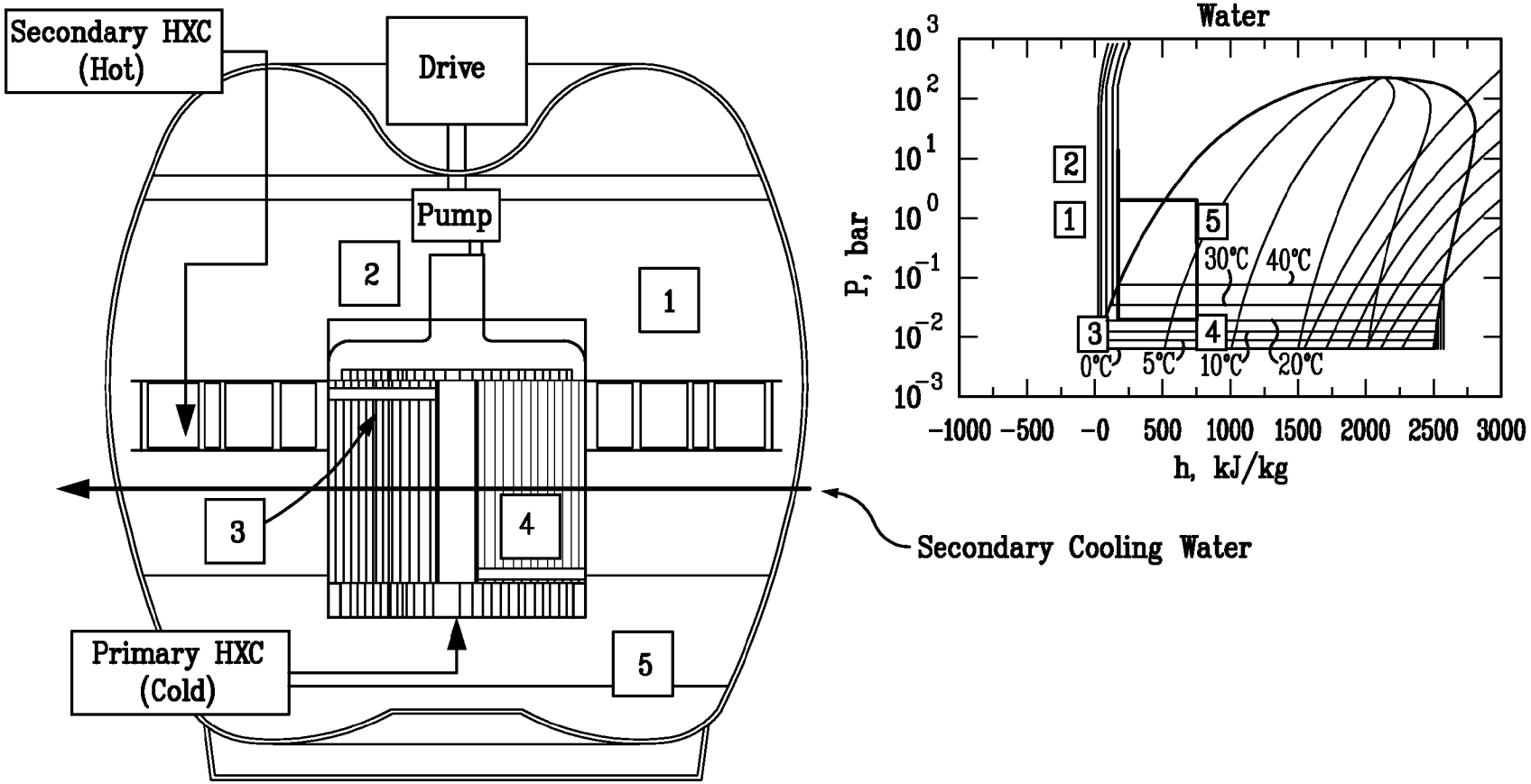
FIG. 4 illustrates performance of a supersonic cooling system like that illustrated in FIG. 3.

The coolant fluid of system 300 (having now absorbed heat for dissipation) may be cooled at a heat exchanger to assist in dissipating heat once the coolant has absorbed the same (approximately 90-100 F after having exited evaporator 350). Instead of an actual heat exchanger, however, the housing 310 of the system 300 (as was noted above) may be used to cool via forced convection. FIG. 4 illustrates performance of a supersonic cooling system like that illustrated in FIG. 3.

Figure 5:
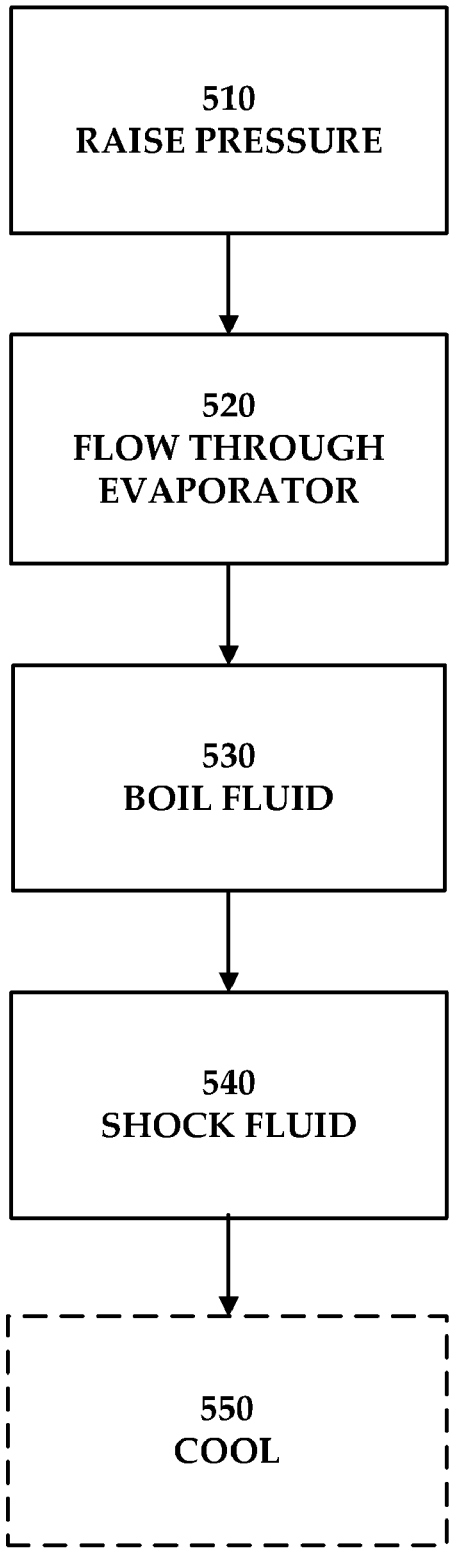
FIG. 5 illustrates a method of operation for the supersonic cooling system of FIG. 3.

FIG. 5 illustrates a method of operation 500 for the supersonic cooling system 300 of FIG. 3. In step 510, a gear pump 330 raises the pressure of a liquid. The pressure may, for example, be raised from 20 PSI to in excess of 100 PSI. In step 520, fluid flows through the nozzle/evaporator 350. Pressure drop and phase change result in a lower temperature in the tube. Fluid is boiled off in step 530.

Critical flow rate, which is the maximum flow rate that can be attained by a compressible fluid as that fluid passes from a high pressure region to a low pressure region (i.e., the critical flow regime), allows for a compression wave to be established and utilized in the critical flow regime. Critical flow occurs when the velocity of the fluid is greater or equal to the speed of sound in the fluid. In critical flow, the pressure in the channel will not be influenced by the exit pressure and at the channel exit, the fluid will 'shock up' to the ambient condition. In critical flow the fluid will also stay at the low pressure and temperature corresponding to the saturation pressures. In step 540, after exiting the evaporator tube 360, the fluid "shocks" up to 20 PSI. A secondary heat exchanger may be used in optional step 550. Secondary cooling may also occur via convection on the surface of the system 300 housing 310.

While various embodiments have been described above, it should be understood that they have been presented by way of example only, and not limitation. The descriptions are not intended to limit the scope of the invention to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the invention as defined by the appended claims and otherwise appreciated by one of ordinary skill in the art. The scope of the invention should, therefore, be determined not with reference to the above description, but instead should be determined with reference to the appended claims along with their full scope of equivalents.

What is claimed is:

1. A supersonic cooling system, comprising:

a flow path having a high pressure region and a low pressure region;

a pump disposed at the high pressure region of the flow path, the pump facilitating the flow of fluid through the flow path; and an evaporator that facilitates a phase change of a fluid traversing the flow path, wherein the low pressure region of the flow path is located within the evaporator, the pump feeds the fluid without having passed through a heater into the evaporator, and the flow path transports a flow of fluid at a velocity that is greater than the speed of sound in the fluid when the fluid undergoes the phase change as the fluid is transported from the high pressure region of the flow path to the low pressure region of the flow path.

2. The supersonic cooling system of claim 1, wherein the fluid undergoes a drop in temperature during the phase change, whereby the fluid may be used for cooling.

3. The supersonic cooling system of claim 1, wherein the evaporator includes an evaporator tube that maintains a constant pressure across the evaporator tube.

4. The supersonic cooling system of claim 1, wherein the flow path decreases a pressure of the fluid at substantially constant enthalpy.

5. The supersonic cooling system of claim 1, wherein the fluid includes water.

6. The supersonic cooling system of claim 1, further comprising a heat exchanger for transferring heat to the fluid during the phase change.

7. A cooling system, comprising:

a flow path;

a pump that circulates a fluid through the flow path; and an evaporator that induces a pressure drop and phase change in the fluid as it is circulated through the flow path, wherein the pump feeds the fluid into the evaporator without passing through an intermediate heater and the evaporator operates in the critical flow regime.

8. The cooling system of claim 7, wherein the flow path includes a high pressure region and a low pressure region, the fluid circulating at a velocity greater than the speed of sound in the fluid when transported from the high pressure region to the low pressure region of the flow path, the low pressure region located within the evaporator.

9. The cooling system of claim 7, wherein the phase change of the fluid occurs during a drop in temperature of the fluid, whereby the fluid may be used for cooling.

10. The cooling system of claim 9, wherein the evaporator includes an evaporator tube having a constant pressure across the evaporator tube.

11. A method for supersonic cooling, comprising:

flowing a fluid through a flow path, the flow path having a high pressure region and a low pressure region, the fluid flowing through the flow path with the aid of a pump;

dropping the pressure of the flowing fluid at an evaporator situated at the low pressure region of the flow path, wherein the flowing fluid is fed into the evaporator by the pump without passing through an intermediate heater; and inducing a phase change of the flowing fluid at the evaporator, the evaporator operating in the critical flow regime.

12. The method of claim 11, wherein the phase change includes the transfer of heat to the fluid.

13. The method of claim 12, wherein transferring heat to the fluid occurs by way of a heat exchanger.

14. The method of claim 11, further comprising shocking the fluid up to an elevated pressure upon exiting the evaporator.

15. The method of claim 14, wherein the fluid shocks up to the elevated pressure at substantially constant enthalpy.

16. The method of claim 11, wherein the fluid flows from a high pressure region to a low pressure region of the flow path at substantially constant enthalpy.

17. The method of claim 11, wherein the fluid flows at a velocity greater than the speed of sound in the fluid when the fluid is transported from the high pressure region to the low pressure region of the flow path.

18. The cooling system of claim 7, wherein the evaporator generates a compression wave in the fluid.

19. The method of claim 17, wherein the evaporator generates a compression wave in the fluid.

* * * * *